US005575208A

United States Patent [19]

Kirihara

[11] Patent Number: 5,575,208

[45] Date of Patent: Nov. 19, 1996

[54] INK PUMP CONTROL SYSTEM

[75] Inventor: Tetsuya Kirihara, Tokyo, Japan

[73] Assignee: Tokyo Kikai Seisakusho Ltd., Tokyo, Japan

[21] Appl. No.: 388,393

[22] Filed: Feb. 14, 1995

[30] Foreign Application Priority Data

Mar. 4, 1994 [JP] Japan ..... 6-034386

[51] Int. Cl.[6] ..... B41F 31/08; B41L 27/10

[52] U.S. Cl. ..... 101/366

[58] Field of Search ..... 101/366, 365, 101/148, 349, 350, 207–210; 318/696; 118/410, 669, 679, 683, 688

[56] References Cited

U.S. PATENT DOCUMENTS 4,899,653 2/1990 Michl et al. ..... 101/366 X

FOREIGN PATENT DOCUMENTS 174447 11/1989 Japan .

*Primary Examiner*—J. Reed Fisher
*Attorney, Agent, or Firm*—McGlew and Tuttle

[57] ABSTRACT

An ink pump control system for an ink pump installed on printing presses, driven by a stepping motor, with the ink feed thereof being controlled in accordance with the revolution of the stepping motor, including a first pulse output device for outputting a pulse signal proportional to the operating speed of the rotary press, a memory device for storing ON/OFF bit strings in accordance with a printing element ratio of a plate surface area to which ink is to be fed obtained in advance by a printing element ratio measuring device, a second pulse output device for sequentially reading each bit in the ON/OFF bit string stored in the memory device every time a pulse signal outputted by the first pulse output device is inputted, and outputting a pulse signal in accordance with the read bits, and a motor driver for operating the stepping motor in accordance with the pulse signal outputted by the second pulse output device, so that ink feed is controlled optimally.

12 Claims, 10 Drawing Sheets

FIG. 10

| INK FEED CORRECTION COEFFICIENT, Nn | ON / OFF BIT STRING, BL |
|---|---|
| 0 | 0 0 0 0 0 0 0 0 |
| 1 | 0 0 0 0 1 0 0 0 |
| 2 | 0 0 1 0 0 0 1 0 |
| 3 | 0 0 1 0 1 0 0 1 |
| 4 | 0 1 0 1 0 1 0 1 |
| 5 | 1 1 0 1 0 1 1 0 |
| 6 | 1 1 0 1 1 1 0 1 |
| 7 | 1 1 1 1 0 1 1 1 |
| 8 | 1 1 1 1 1 1 1 1 |

FIG. 11

| INK FEED CORRECTION COEFFICIENT, Nn | ON / OFF BIT STRING, BL |
|---|---|
| 0 | 0 0 0 0 0 0 0 0 0 0 |
| 1 | 0 0 0 0 0 1 0 0 0 0 |
| 2 | 0 0 1 0 0 0 0 1 0 0 |
| 3 | 0 1 0 0 0 1 0 0 1 0 |
| 4 | 0 1 0 0 1 0 1 0 0 1 |
| 5 | 0 1 0 1 0 1 0 1 0 1 |
| 6 | 1 0 1 1 0 1 0 1 1 0 |
| 7 | 1 0 1 1 1 0 1 1 0 1 |
| 8 | 1 1 0 1 1 1 1 0 1 1 |
| 9 | 1 1 1 1 1 0 1 1 1 1 |
| 10 | 1 1 1 1 1 1 1 1 1 1 |

FIG. 12

| INK FEED CORRECTION COEFFICIENT, Nn | ON / OFF BIT STRING, BL |
|---|---|
| 0 | 0 0 0 0 0 0 0 0 0 0 0 0 0 0 0 0 |
| 1 | 0 0 0 0 0 0 0 0 1 0 0 0 0 0 0 0 |
| 2 | 0 0 0 0 1 0 0 0 0 0 0 0 1 0 0 0 |
| 3 | 0 0 1 0 0 0 0 0 1 0 0 0 0 1 0 0 |
| 4 | 0 0 1 0 0 0 1 0 0 0 1 0 0 0 1 0 |
| 5 | 0 1 0 0 1 0 0 0 1 0 0 1 0 0 1 0 |
| 6 | 0 0 1 0 0 1 0 1 0 0 1 0 0 1 0 1 |
| 7 | 0 1 0 1 0 1 0 0 1 0 1 0 1 0 1 0 |
| 8 | 0 1 0 1 0 1 0 1 0 1 0 1 0 1 0 1 |
| 9 | 1 0 1 0 1 0 1 1 0 1 0 1 0 1 0 1 |
| 10 | 1 1 0 1 1 0 1 0 1 1 0 1 1 0 1 0 |
| 11 | 1 0 1 1 0 1 1 1 0 1 1 0 1 1 0 1 |
| 12 | 1 1 0 1 1 1 0 1 1 1 0 1 1 1 0 1 |
| 13 | 1 1 0 1 1 1 1 1 0 1 1 1 1 0 1 1 |
| 14 | 1 1 1 1 0 1 1 1 1 1 1 1 0 1 1 1 |
| 15 | 1 1 1 1 1 1 1 1 0 1 1 1 1 1 1 1 |
| 16 | 1 1 1 1 1 1 1 1 1 1 1 1 1 1 1 1 |

INK PUMP CONTROL SYSTEM

BACKGROUND OF THE INVENTION

1. Field of the Invention

This invention relates generally to an ink pump control system, and more specifically to an ink pump control system for optimally controlling ink feed by controlling the revolution of a stepping motor as the drive unit of the ink pump in accordance with printing speed and printing element ratio (the ratio of printing element area to the sum of a printing element area and a non-printing area on a plate surface to which ink is to be fed).

2. Description of the Prior Art

There are various types of ink feeders for feeding ink to printing presses for printing newspaper and other printed matter. Among such ink feeders, a construction of an ink feeder in which an ink pump installed on a printing press is driven by a stepping motor, and ink feed is changed by controlling the revolution of the stepping motor in accordance with each input data of printing speed, printing element ratio and printing density is publicly known. (Refer to Japanese Published Unexamined Patent Publication No. Hei-1(1989)-174446 and Japanese Published Unexamined Patent Publication No. Hei-1(1989)-174447, for example.)

In the aforementioned publicly known ink pump control system, a frequency division ratio for dividing a basic clock frequency (oscillation frequency) is obtained based on each input data of printing speed, printing element ratio and printing density, and frequency division pulses obtained by dividing the basic clock frequency at the frequency division ratio obtained are applied to the stepping motor as the drive unit of the ink pump to effect control so that the optimum ink feed at a given moment can be obtained in accordance with the printing state at that moment.

With the conventional construction, however, calculation based on printing speed and printing density, calculation based on printing element ratio, and frequency division of the basic clock by means of an oscillating circuit based on these calculations are carried out by a CPU. This requires an ink pump control system to have a CPU capable of highly complex calculation and processing, resulting in increased manufacturing cost of the system.

Furthermore, the control accuracy of the ink pump control system tends to be lowered due to accumulated errors involved with numerous calculations, signal output processing based on the calculations, frequency division based on the outputted signals.

SUMMARY OF THE INVENTION

It is an object of this invention to provide an ink pump control system that can optimally control ink feed at high accuracy.

It is another object of this invention to provide a control means for efficiently controlling a plurality of ink pump control systems.

It is still another object of this invention to provide a printing element ratio measuring means needed for optimally controlling ink feed.

It is a further object of this invention to provide ON/OFF bit strings in accordance with a printing element ratio to ensure the optimum control of ink feed.

BRIEF DESCRIPTION OF THE DRAWINGS

FIG. 10 is a diagram illustrating ON/OFF bit strings corresponding to ink feed factors when the ink feed factor is set to nine levels from 0 through 8.

FIG. 11 is a diagram illustrating ON/OFF bit strings corresponding to ink feed factors when the ink feed factor is set to eleven levels from 0 through 10.

FIG. 12 is a diagram illustrating ON/OFF bit strings corresponding to ink feed factors when the ink feed factor is set to 17 levels of 0 through 16.

DETAILED DESCRIPTION OF PREFERRED EMBODIMENTS

Figure 1:
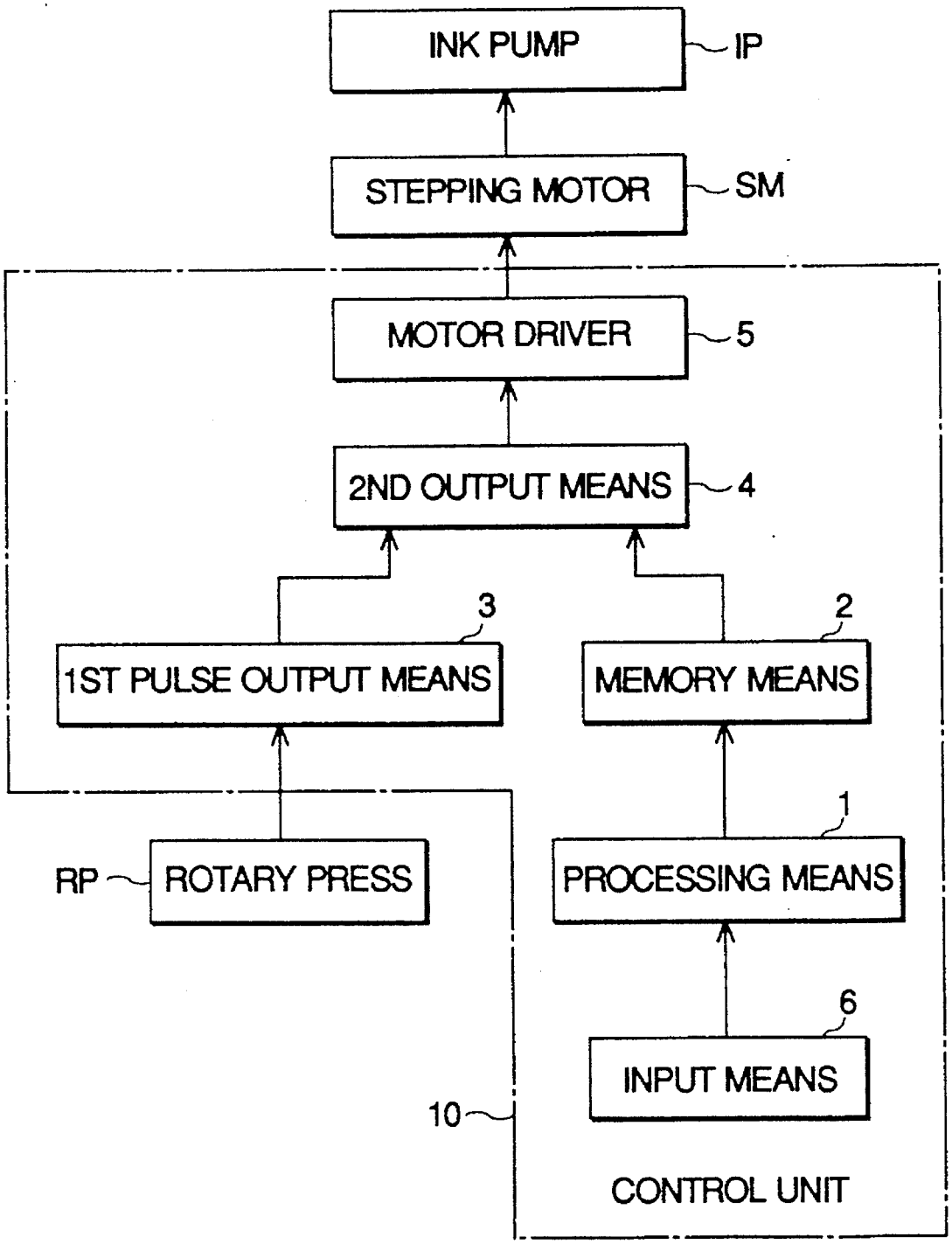
FIG. 1 is a block diagram illustrating an electrical system of this invention.

FIG. 1 is a diagram illustrating the outline of an electrical system of this invention.

In FIG. 1, a control unit 10 shown by a chain line comprises a processing means 1, a memory means 2, a first pulse output means 3, a second pulse output means 4, a motor driver 5 and an input means 6.

The processing means 1 is linked to the input means 6. An ink feed factor $N_n$ corresponding to the printing element ratio of a plate surface area to which ink is to be fed is inputted in advance to the processing means 1 via the input means 6. The processing means 1 generates an ON/OFF bit string BL by designating ON bits or OFF bits following a predetermined procedure so that ON bits are distributed almost evenly in the bit string corresponding to the ink feed factor $N_n$.

The number of bits, M, constituting the above-mentioned ON/OFF bit string BL is determined by the number of levels into which an ink feeding range of zero to the maximum level is divided. That is, if the ink feeding level is divided into L levels, the number of bits M is (L-1). Note that the ink feeding levels are predetermined so as to match the levels of the ink feed factor $N_n$, and the number of bits M is given in advance to the processing means 1.

The memory means 2 linked to the processing means 1 stores the ON/OFF bit string BL prepared by the processing means 1. A RAM or a shift register, which will be described later, is used as the memory means 2.

When the rotary press RP is operated, the first pulse output means 3 linked to the drive unit, for example, of the rotary press RP outputs a pulse signal proportional to the operating speed of the rotary press RP.

The second pulse output means 4 linked to the memory means 2 and the first pulse output means 3 receives the pulse signal outputted by the first pulse output means 3, sequentially reads each bit one by one from the leading to the trailing ends of the ON/OFF bit string BL stored in the memory means 2 upon receiving every pulse of the pulse signal, and as the above reading opera- tion is repeated, outputs a pulse signal upon reading every ON bit.

The motor driver 5 having a function of amplifying power to operate a stepping motor SM is linked to the second pulse output means 4, receives the pulse signal outputted by the second pulse output means 4, and operates the stepping motor SM in accordance with this pulse signal, causing the stepping motor SM to operate to drive the ink pump IP.

In the aforementioned manner, the operation of a stepping motor can be controlled in conjunction with the operating speed of the rotary press and the printing element ratio, so that ink feed can be controlled by the ink pump driven by the stepping motor.

There can be an arrangement in which the ON/OFF bit string BL having the number of bits M prepared by the aforementioned processing means 1, etc. may be inputted from the outside and stored in the memory means 2.

Figure 2:
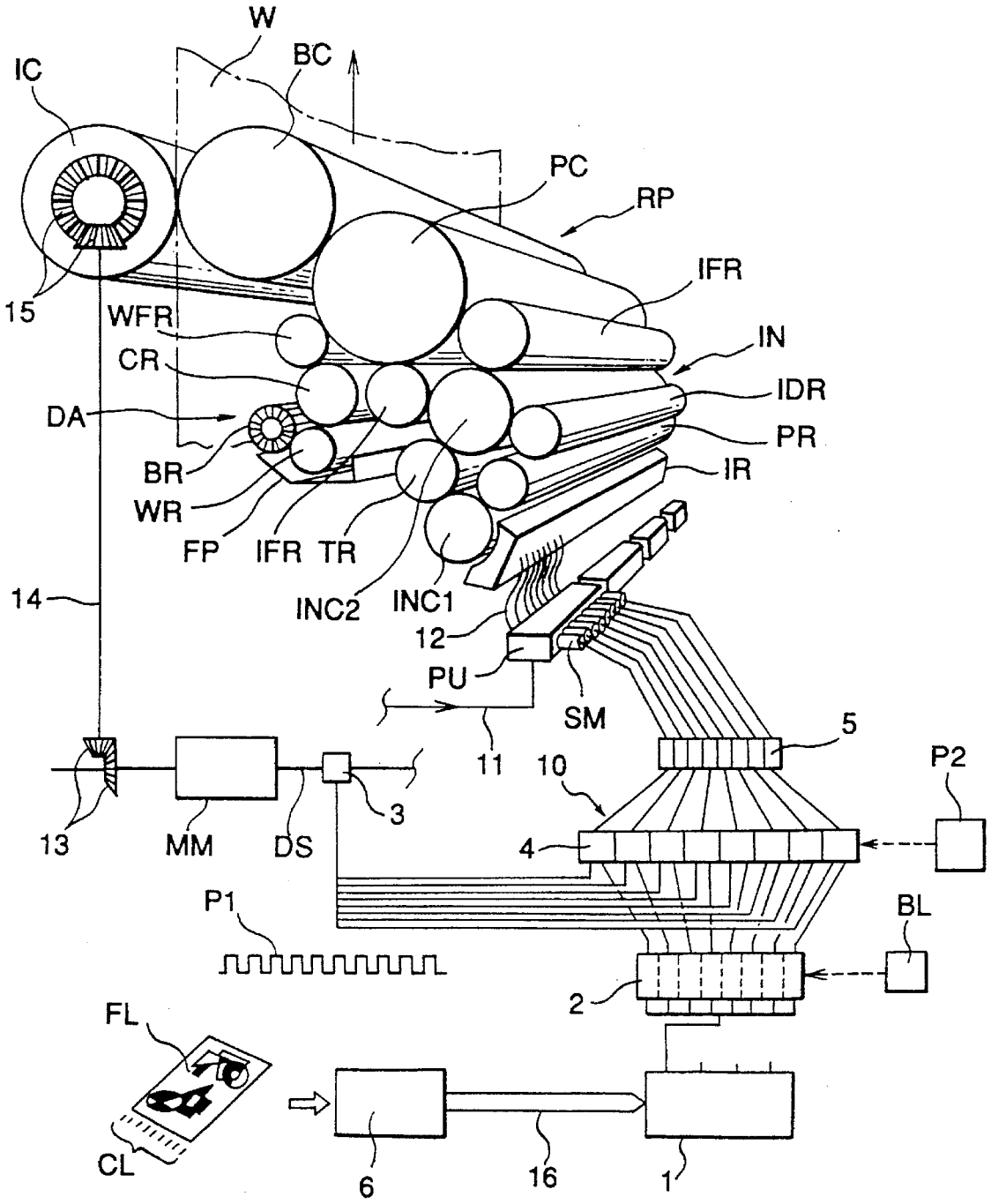
FIG. 2 is a diagram illustrating a general view of an embodiment of this invention.

FIG. 2 is a diagram illustrating a general view of an embodiment of this invention in which an ink pump control system of this invention is applied to a newspaper offset press. In FIG. 2, like numerals denote like parts shown in FIG. 1.

In FIG. 2, a rotary press RP causes a paper web W to travel in a direction shown by an arrow between an impression cylinder IC and a blanket cylinder BC, and feeds ink onto a plate (not shown) attached to a plate cylinder PC via an inking assembly IN to cause printing elements on the plate to be transferred on the paper web W via the blanket cylinder BC.

The inking assembly IN comprises a first ink cylinder INC1; a pen roller PR and a transfer roller TR, both in rolling contact with the first ink cylinder INC1; a second ink cylinder INC2 in rolling contact with the transfer roller TR; an ink form roller IFR and an ink distributing roller IDR, both in rolling contact with the second ink cylinder INC2; an ink rail IR for feeding ink to the first ink cylinder INC1; and an ink pump unit PU driven by a stepping motor SM, for example.

Symbol DA denotes a dampening arrangement comprising a fountain pan FP, a water fountain roller WR, a brush roller BR, a chromium roller CR, and a water form roller WFR to continuously feed dampening water uniformly on the non print-element area of the plate cylinder PC.

The plate cylinder PC has a capacity of carrying a total of eight pages of newspaper; four pages in the axial direction thereof and two pages in the circumferential direction thereof, for example. One page of newspaper is divided into eight areas or columns in the axial direction, with one ink pump allocated to each column. The eight ink pumps are assembled into an ink pump unit PU to feed ink over the entire width of one page of newspaper on the plate cylinder PC. The suction side of the ink pump unit PU is connected to an ink tank via piping 11, and the delivery side thereof to the ink rail IR via piping 12.

Symbol MM denotes a main motor comprising a drive main shaft DS, a bevel gear 13, a drive shaft 14 and a bevel gear 15 to drive the rotary press RP. The first pulse output means 3 linked to the drive main shaft DS is adapted so as to output a pulse signal P1 in proportion to the rotating speed of the drive main shaft DS.

Figure 13:
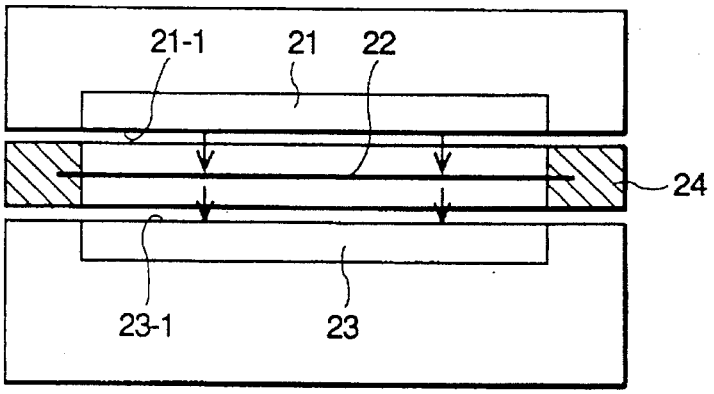
FIG. 13 is a diagram of assistance in explaining an example of a printing element ratio measuring means.

Next, symbol FL denotes a process film which corresponds one page of newspaper, for example, and the printing element ratio of the process film FL is measured for each column CL, which is obtained by dividing the process film FL into eight columns, via a printing element ratio measuring means, etc. as shown in Fig. 13, for example, so that the printing element ratio can be inputted into the processing means 1 via the input means 6 and the bus 16.

FIG. 13 is a diagram of assistance in explaining an example of the printing element ratio measuring means.

In FIG. 13, numeral 21 denotes a light source, 21-1 a light source surface, 22 a process film (FL), 23 a photoelectric element, 23-1 a light receptor surface, and 24 a transport unit, respectively.

The light source surface 21-1 irradiated by the light source 21, such as an EL light source, is disposed facing the light receptor surface 23-1 of the photoelectric element 23 having an array of solar cells, for example, with a gap left therebetween. The process film 22 is sequentially and intermittently passed through the gap in the increments of one column CL of the process film 22 by means of a feed mechanism of the transport unit 24.

During the intermittent movement of the process film 22, the amount of transmitted light for each column CL of the process film 22 is measured with the passage of time on the basis of changes in the electromotive force of the photoelectric element 23 provided on the light receptor surface 23-1 to obtain a printing element ratio for each column CL of the process film 22.

The processing means 1 is connected to the memory means 2 comprising eight RAMs, for example, so that the ON/OFF bit string BL prepared by the processing means 1 can be stored in the memory means 2. The first pulse output means 3 is connected to eight pieces, for example, of the second pulse output means 4 so that a pulse signal P1 can be transmitted and received, and the memory means 2 is connected to the second pulse output means 4 so that the signal of the ON/OFF bit string BL stored in the memory means 2 can be transmitted and received. Furthermore, the second pulse output means 4 is connected to the motor driver 5 so that a pulse signal P2 outputted by the second pulse output means 4 can be transmitted and received, and the motor driver 5 is connected to the stepping motor SM so that the stepping motor SM can be operated in accordance with the pulse signal P2.

In FIG. 2, eight pieces, for example, of the stepping motors SM serving only one ink pump unit PU are illustrated to facilitate understanding. Similarly, only one unit of the ink pump unit PU is illustrated in the figure as the constituent means of the control unit 10, but the processing means 1 can handle a plurality of the ink pump units PU.

Figure 3A:
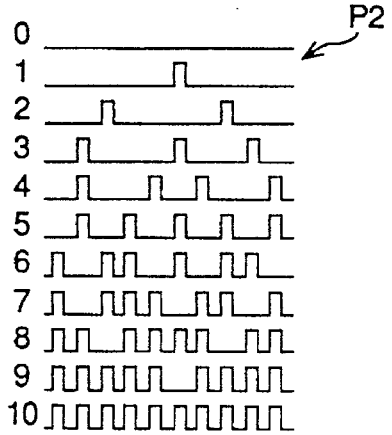
FIG. 3(A), 3(B) are a diagram of assistance in explaining examples of a pulse signal P2 and an ON/OFF bit string BL; (a) being the pulse signals P2 and (b) the ON/OFF bit strings BL.
Figure 3B:
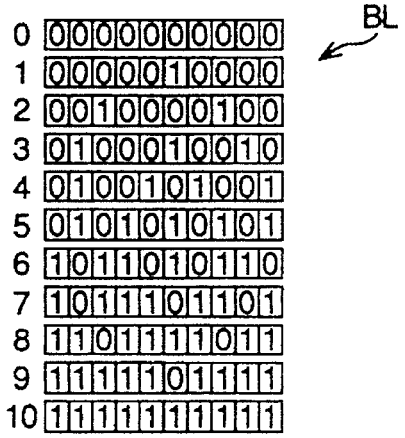

FIG. 3 is a diagram of assistance in explaining an example of the pulse signal P2 and the ON/OFF bit string BL shown in FIG. 2. FIG. 3(A) represents the pulse signal P2, and FIG.3(B) represents the ON/OFF bit string BL. In FIGS. 3 (*a*) and (*b*), numerals on the left represent the ink feed factor $N_n$ corresponding to the printing element ratio of an area of the plate surface to which ink is to be fed. In the figure, the ink feed factor $N_n$ is divided into 11 levels from 0 to 10, which will be described later.

Figure 4:
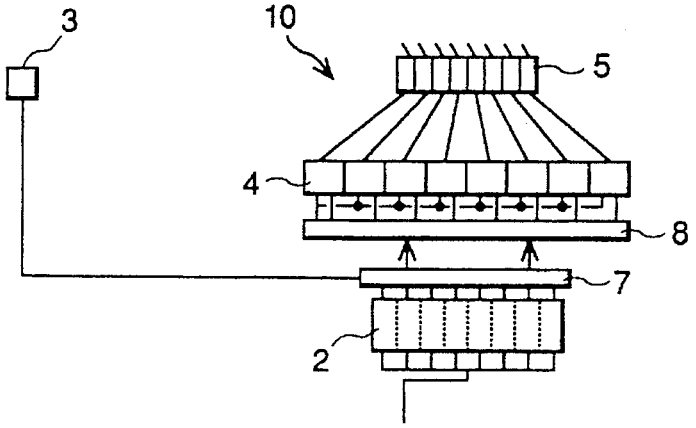
FIG. 4 is a diagram of assistance in explaining another embodiment of this invention.

FIG. 4 is a diagram illustrating another embodiment of this invention. Like numerals indicate like parts shown in FIG. 2.

In FIG. 4, numeral 7 denotes a transmitting means, 8 a receiving means, both being adapted so that the pulse signal P1 from the first pulse output means 3 shown in FIG. 2 and the ON/OFF bit string BL stored in the memory means 2 as shown in FIG. 3 (*b*), for example, can be transmitted and received.

That is, the transmitting means 7 is connected to the first pulse output means 3 and eight memory means 2, for example, and the receiving means 8 is connected to eight second pulse output means 4, for example. The aforementioned signals can be transmitted and received one by one, or simultaneously from the transmitting means 7 to the receiving means 8.

With the aforementioned construction, the number of lines linking the memory means 2 and the first pulse output means 3 to the second pulse output means 4 can be reduced to less than those shown in FIG. 2, leading to reduced manufacturing cost.

With the aforementioned construction, the printing element ratio of each column obtained by dividing one page of newspaper in the across-the-width direction into eight areas via the process film FL in FIG. 2 is measured using the printing element ratio measuring means described in reference to FIG. 13 to obtain the ink feed factors $N_1$, $N_2$, - - - $N_n$ corresponding to the printing element ratios for these areas, and inputted into the processing means 1 via the input means 6 and the bus 16. The processing means 1, into which the ink feed factors $N_1$, $N_2$, - - - $N_n$ are inputted, prepares ON/OFF bit strings BL sequentially for the ink feed factors $N_1$, $N_2$, - - - $N_n$ in accordance with the procedures in the flow chart, which will be described later, to store in the memory means 2.

Next, the second pulse output means 4 receives the pulse signal P1 from the first pulse output means 3, sequentially reads bits from the leading and trailing ends of the ON/OFF bit string BL stored in the memory means 2 one by one for each pulse of the pulse signal P1, and outputs a pulse signal P2 every time an 0N bit is read.

The motor driver 5 actuates the stepping motor SM in accordance with the pulse signal P2 outputted by the second pulse output means 4 to drive the ink pump. Thus, ink is fed from the ink pump unit PU to the ink rail IR.

That is, the stepping motor SM changes the rotating angle for a predetermined number of the pulse signal P1 from the first pulse output means 3, depending on the size of the ink feed factor $N_k$ ($O \leqq k \leqq n$) corresponding to the printing element ratio measured by the printing element measuring means, and changes the number of revolution per unit time in proportion to the operating speed of the rotary press RP. In other words, if the operating speed of the rotary press RP remains constant, the larger the ink feed factor $N_k$, the more becomes the number of ON bits, "1s," in the ON/OFF bit string BL corresponding to the ink feed factor $N_k$, leading to an increase in ink feed. The smaller the ink feed factor $N_k$, the smaller becomes the number of ON bits, "1s," in the ON/OFF bit string BL corresponding to the ink feed factor $N_k$, leading to a decrease in ink feed. Thus, ink feed can be changed in proportion to the operating speed of the rotary press RP. In this case, pulses of the pulse signal P2 are distributed almost evenly because ON bits, "1s," are distributed almost evenly in the ON/OFF bit string BL, as is apparent from the bit configuration of the ON/OFF bit string BL corresponding to the ink feed factor shown in FIG. 3. This results in smooth operation of the stepping motor SM shown in FIG. 2. As one can see from the drawings it is preferable to evenly distribute the bits by distributing them substantially symmetrically about a center of the string.

FIGS. 5 through 8 are flow charts illustrating an embodiment of this invention where a processing means according to this invention prepares an ON/OFF bit string BL.

The outline of the embodiment shown in FIGS. 5 through 8 is as follows.

First, the processing means examines what location in the number of levels (=M−1) of the ink feed factor $N_o$ through $N_n$ an inputted ink feed factor $N_k$, that is, an ink feed factor $N_k$ corresponding to a printing element ratio measured by the printing element ratio measuring means belongs to.

When the inputted ink feed factor $N_k$ is $N_k=N_o$, that is, when there are no (or extremely few) printing elements to be printed, all the bits of the ON/OFF bit string BL are changed to OFF bits, "0s," since there is no need of feeding ink. This processing is represented by steps 101 and 102 in FIG. 5.

When $N_k$ of the inputted ink feed factor $N_k$ is $N_n$, that is, when there are a great many printing elements to be printed, all the bits of the ON/OFF bit string BL are changed to ON bits, "1s," since the maximum amount of ink must be fed. This processing is indicated by steps 103, 105 through 107, and 109 in FIG. 5.

When the inputted ink feed factor $N_k$ belongs to the first half ($N_k \leqq M/2$) of the number of levels of the ink feed factor $N_k$ the processing means 1 proceeds to the processing for evenly allocating k ON/OFF bits to M bits. This processing is indicated by steps 103 and 104 shown in FIG. 5.

When the inputted ink feed factor $N_k$ belongs to the second half ($N_k > M/2$) of the number of levels L of the ink feed factor $N_k$, the processing means 1 proceeds to the processing for allocating k ON/OFF bits to M bits, as in the case described above. When executing the processing for allocating k ON/OFF bits to M bits, the bit configuration of the ON/OFF bit string BL of the ink feed factor $N_k$ belonging to the second half of the number of levels L is made symmetrical to the bit configuration of the ON/OFF bit string BL of the ink feed factor $N_{M-k}$ belonging to the first half of the number of levels L with respect to the ON/OFF bit string BL at the central position of the ink feed factor $N_n$.

In other words, when the inputted ink feed factor $N_k$ belongs to the second half ($N_k > M/2$), then an ON/OFF bit string BL corresponding to that ink feed factor $N_k$ is obtained in the processing for evenly allocating k ON/OFF bits to M bits, as in the case of the ink feed factor $N_{M-k}$ belonging to the first half ($N_k \leqq M/2$) that is symmetrical with respect to the ink feed factor at the central position of the ink feed factor $N_n$, and each bit is reversed. This processing is indicated by steps 103, 105, 106, 108 and 109 in FIG. 5.

The k bits of ON/OFF bits can be evenly allocated to M bits by arranging k bit strings of OFF bits, "0s," consisting of (M−k)/k bits after one bit is turned ON. This ON-bit allocating processing is indicated by step 221 in FIG. 8, while the processing for allocating (M−k)/k bits of OFF bits is indicated by steps 221 through 227 in FIG. 8. Judgment of the repeating processing for arranging k bits of the aforementioned ON/OFF bits is indicated by steps 228 and 229 in FIG. 8, and step 214 in FIG. 7 is the initialization processing thereof. The judgment processing for limiting the number of allocated bits to M bits is indicated by step 219 in FIG. 7 and steps 222 and 226 in FIG. 8. The processing for calculating the number of allocations and updating the allocating position is indicated by steps 203 and 204 in FIG. 6, steps 217 and 220 in FIG. 7, and step 224 in FIG. 8.

With these series of processing, however, (M–k)/k bits of OFF bits, "0s," are arranged continuously at the trailing end of the ON/OFF bit string. This can be prevented by arranging half of the OFF bits, "0s," to be allocated at the trailing end of the ON/OFF bit string at the trailing end of the ON/OFF bit string, and the remaining half at the leading end thereof. The processing for allocating OFF bits at the leading end of the ON/OFF bit string is indicated by steps 201 through 205 in FIG. 6.

Since only positive integers can be handled in the ON/OFF bit string BL, the remainder of the OFF bits obtained by the calculation of (M–k)/k bits must be allocated evenly to k OFF-bit strings. To achieve this, 1 OFF bit is added to the (multiple of (k/remainder))-th ON/OFF bit string. The processing for obtaining the allocating position is indicated by steps 207 through 213 in FIG. 6, and the OFF-bit allocating processing by step 218 in FIG. 7. The processing for judging the allocating position during preparation of k ON/OFF bits is carried out in steps 215 and 216 in FIG. 7.

Now, a specific example will be described in the following.

Figure 5:
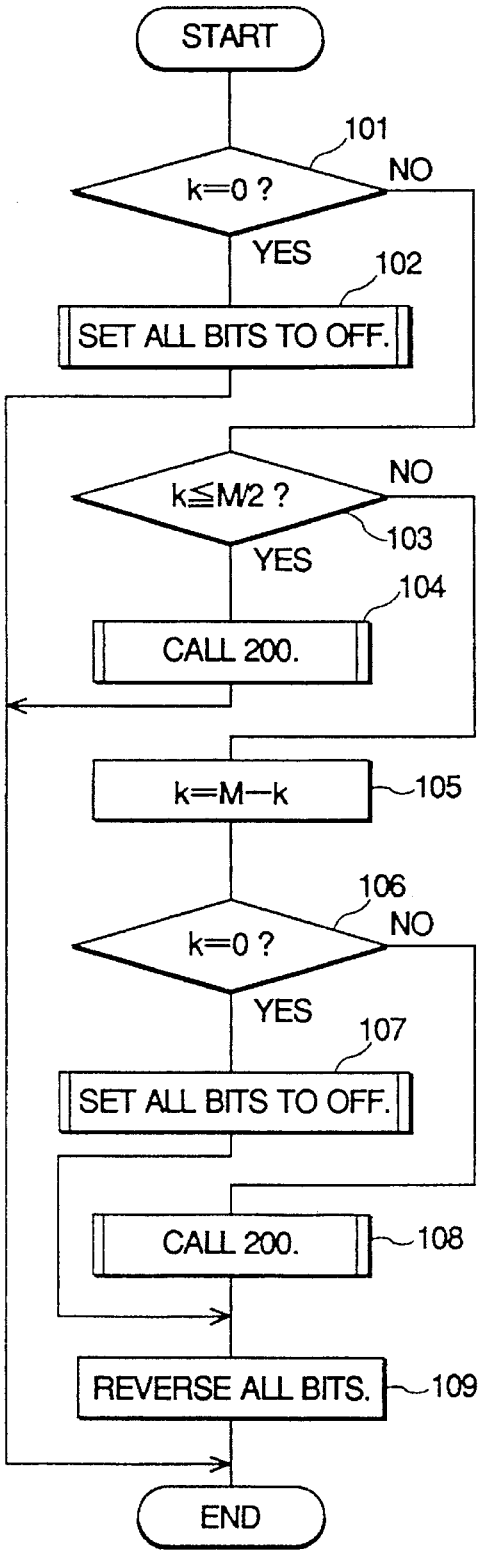
FIG. 5 is a flow chart illustrating a process where the processing means of this invention generates an ON/OFF bit string BL.

When the procedure is started in FIG. 5, whether the ink feed factor $N_k$ (hereinafter expressed as "k" in FIGS. 5 through 8) is "0" or not is judged in step 101. If "k=0," then all the bits of a bit string consisting of M bits are designated as OFF bits (step 102), and the processing ends. In step 101, if k is not "0," the processing proceeds to step 103 and thereafter, and each of the bit string consisting of M bits is designated as ON bit, "1," or OFF bit, "0."

In the above processing, the processing means 1 in FIG. 1 above replaces k with a calculated value of M–k when the value of the ink feed factor $N_k$ exceeds ½ of the total bit number M in the bit string (step 105), carries out the processing for judging whether the replaced k is "0" or not and the subsequent processing (steps 107 through 109), and also carries out the reversing processing to reverse ON bits to OFF bits and OFF bits to ON bits, respectively, for all the bits of the ON/OFF bit string BL prepared in the preceding processing.

In the following, the ON/OFF bit string BL for the ink feed factor $N_k$ of "3" and "7" when the ink feed factor $N_n$ is set to 9levels from 0 to 8, that is, when the number of bits M constituting the bit string is "8," will be obtained.

When the ink feed factor $N_k$ is "3," judgment by the processing means 1 in step 101 in FIG. 5 becomes "NO," because k=3, the processing proceeds to step 103. In step 103, judgment by the processing means 1 becomes "YES" because "k≦8/2=4," the processing in step 104 is moved to procedures shown in flow charts of FIGS. 6 through 8.

Figure 6:
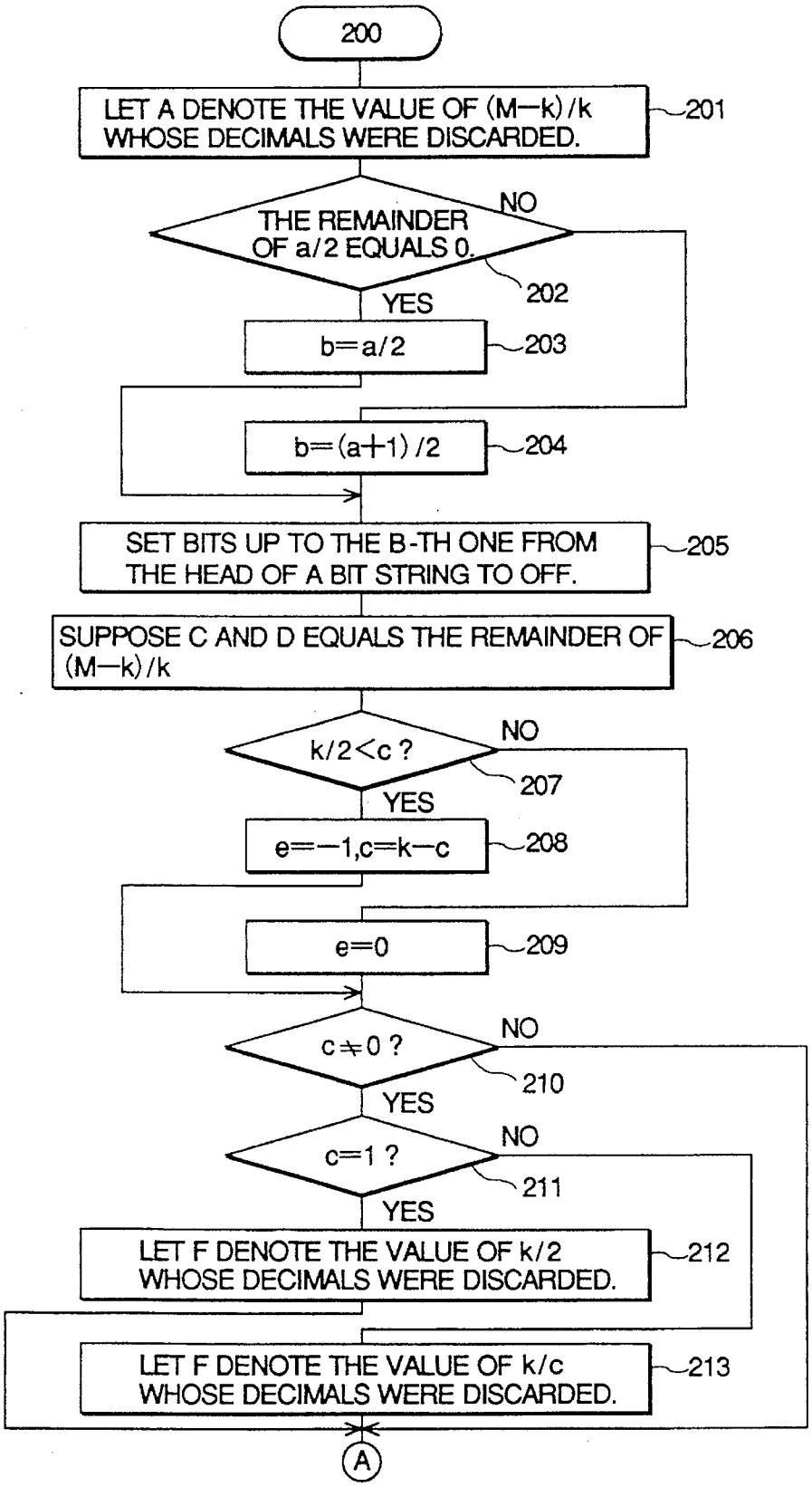
FIG. 6 is a flow chart illustrating a process where the processing means of this invention generates an ON/OFF bit string BL.
Figure 7:
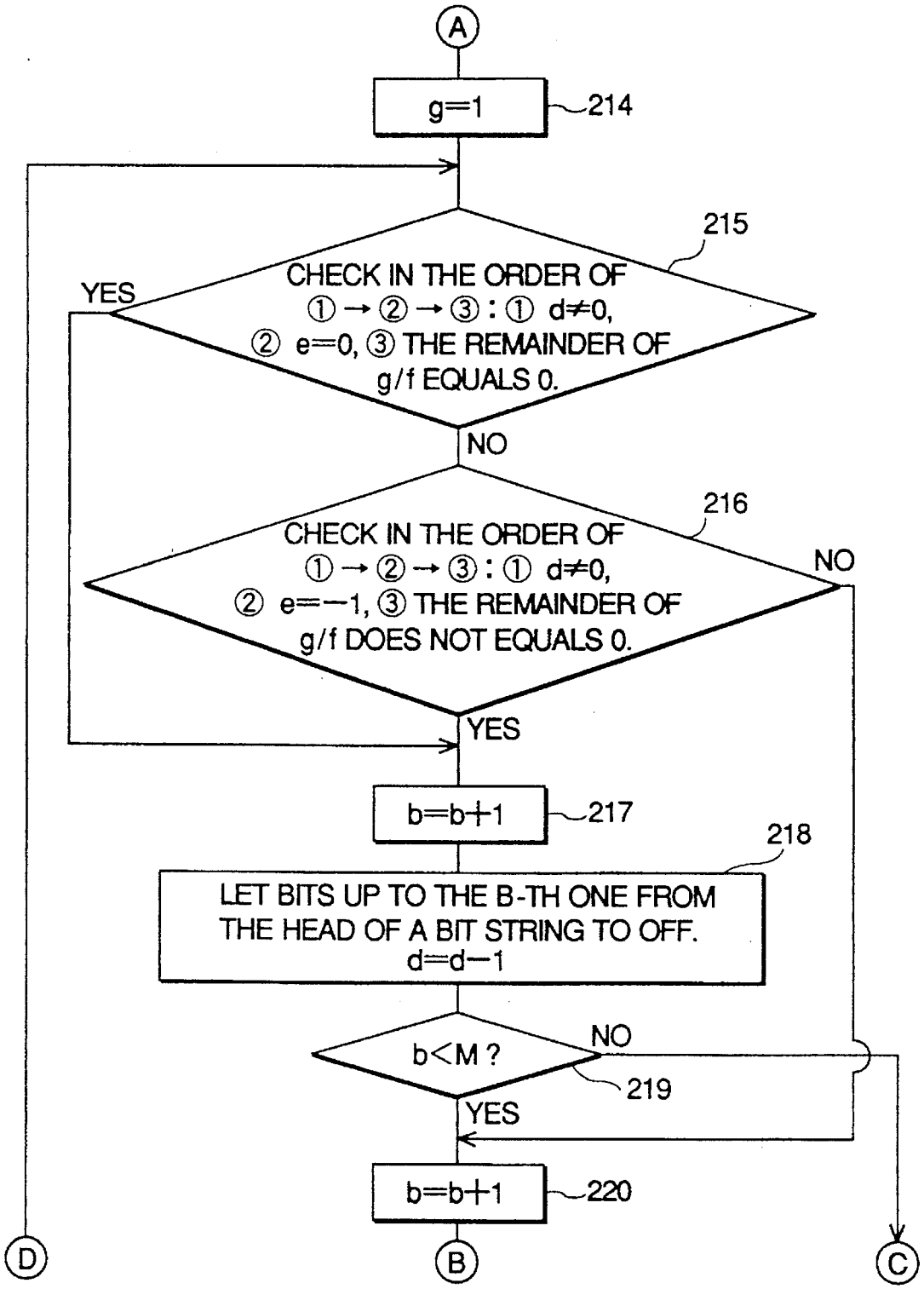
FIG. 7 is a flow chart illustrating a process where the processing means of this invention generates an ON/OFF bit string BL.

In step 201 of FIG. 6, "a=1" because "(M–k)/k=5/3=1 with 2 left." Based on this, judgment in step 202 becomes "NO," the processing proceeds to step 204.

In step 204, the processing means 1 determines "b=(1+1)/2=1," and based on this, designates the first bit of the bit string as "OFF bit" in step 205.

Next, in step 206, the processing means 1 determines "c=d=2," and based on this, judgment by the processing means 1 in step 207 becomes "YES," because "3/2=1.5<c." The processing proceeds to step 208.

In step 208, the processing means 1 determines "e=–1, c=3–2=1," and based on this, judgment in step 210 becomes "YES," and the processing proceeds to step 211. Judgment in step 211 becomes "YES," and the processing is moved to step 212.

In step 212, the processing means 1 determines "f=2," and the processing proceeds to step 214 in FIG. 7. In step 214, the processing means 1 determines "g=1," and the processing further proceeds to step 215. In step 215, judgment becomes "NO" because "d=2, e=–1, g/f=1/2," and the processing proceeds to step 216. Judgment in step 216 becomes "YES," and the processing proceeds to step 217.

In step 217, the processing means 1 determines "b=1+1=2," and based on this, designates the second bit of the bit string as "OFF bit" and determines "d=2–1=1" in step 218. Then, the processing proceeds to step 219, and judgement in step 219 becomes "YES," because "2<8." Thus, the processing proceeds to step 220.

Figure 8:
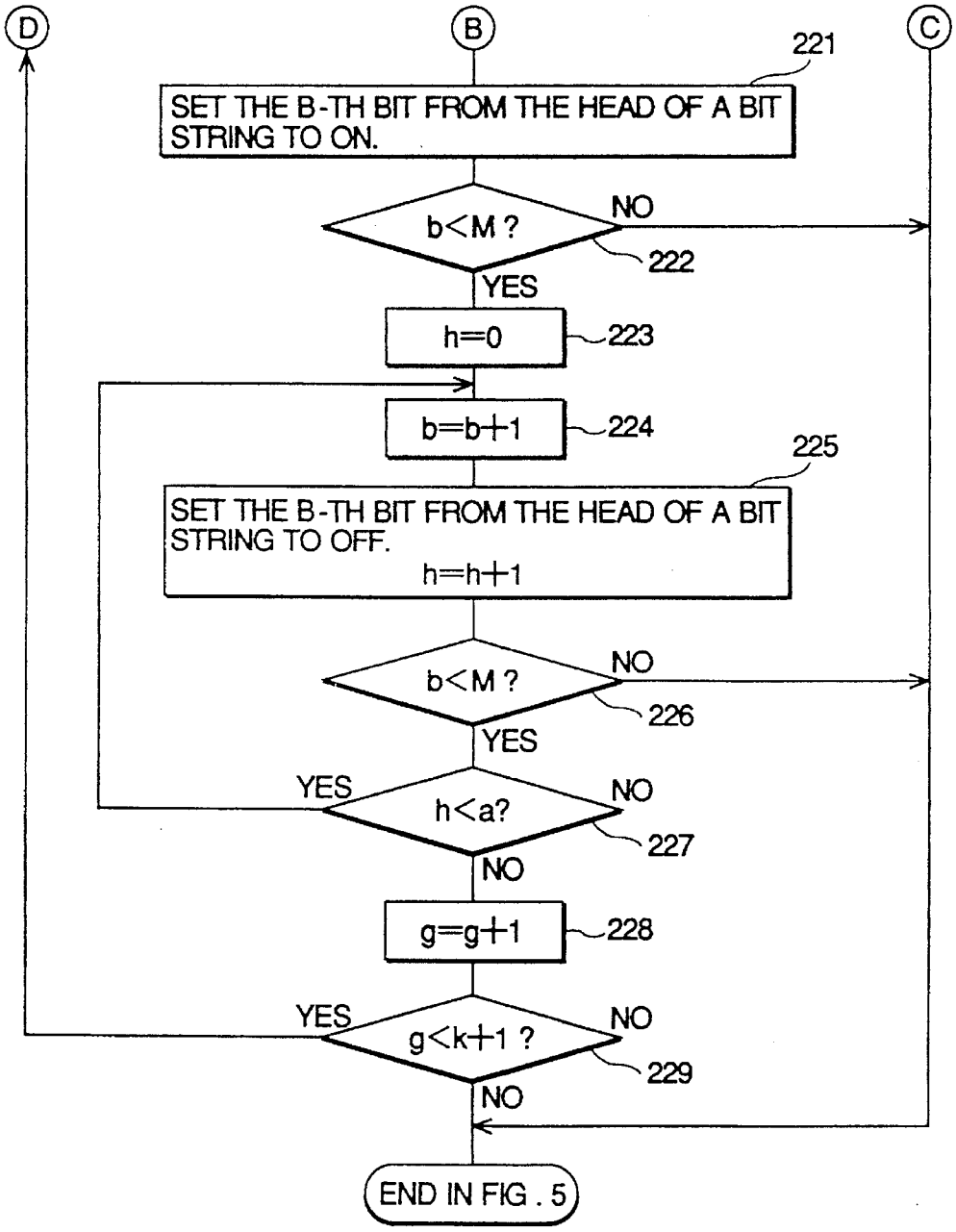
FIG. 8 is a flow chart illustrating a process where the processing means of this invention generates an ON/OFF bit string BL.

In step 220, the processing means 1 determines "b=2+1=3," and based on this, designates the third bit of the bit string as "0N bit" in step 221 shown in FIG. 8. The processing then proceeds to step 222 where judgment becomes "YES" because "3<8." The processing then proceeds to step 223 where "h=0" is determined, and the processing is moved to step 224.

In step 224, the processing means 1 determines "b=3+1=4," and based on this, designates the fourth bit of the bit string as "OFF bit" and determines "h=0+1=1" in step 225. Thus, the processing proceeds to step 226 where judgment becomes "YES" as "4<3." The processing proceeds to step 227 where judgment becomes "NO" because "1<1" does not hold true. The processing proceeds to step 228 where the processing means 1 determines "g=1+1=2," and based on this, judgment in step 229 becomes "YES" because "2<(3+1)." The processing is then moved to step 215 in FIG. 7.

In step 215, judgment becomes "NO" because "d=1, e=–1, g/f=3/2," and based on this, the processing proceeds to step 216 where judgment becomes "NO" and the processing proceeds to step 220.

In step 220, the processing means 1 determines "b=4+1=5," and based on this designates the fifth bit of the bit string as "ON bit" in step 221 shown in FIG. 8. The processing proceeds to step 222 where judgment by the processing means 1 becomes "YES" because "5<8." The processing then proceeds to step 223 where "h=0" is determined, causing the processing to move to step 224.

In step 224, the processing means 1 determines "b=5+1=6," and based on this, designates the sixth bit of the bit string as "OFF bit" and determines "h=0+1=1" in step 225. The processing proceeds to step 226 where judgment becomes "YES" because "6<8." The processing then proceeds to step 227 where judgment becomes "NO" because "1<1" does not hold true. The processing then proceeds to step 228 where "g=2+1=3" is determined, and based on this, judgment in step 229 becomes "YES" because "3<(3+1)."Thus, the processing proceeds to step 215 shown in FIG. 7.

In step 215, judgment becomes "NO" because "d=1, e=–1, g/f=–3/2," and the processing proceeds to step 216 where judgment becomes "YES," causing the processing to move to step 217.

In step 217, the processing means determines "b=6+1=7," and based on this, designates the seventh bit of the bit string as "OFF bit," and determines "d=0" in step 218, and moves the processing to step 219 where judgment becomes "YES" because "7<8." Thus, the processing proceeds to step 220.

In step 220, the processing means 1 determines "b=7+1=8," and based on this, designates the eighth bit of the bit string as "0N bit" in step 221 shown in FIG. 8. The processing then proceeds to step 222 where judgment becomes "NO" because "8<3" does not hold true. This causes step 104 shown in FIG. 5 above to complete.

Figure 9A:
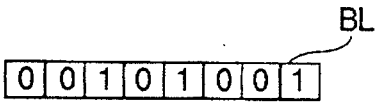
FIG. 9(A), 9(B) are a diagram illustrating ON/OFF bit strings when the ink feed factor is set to nine levels from 0 through 8; (a) showing the bit strings for the ink feed factor of 3, and (b) the bit strings for the ink feed factor of 7.
Figure 9B:
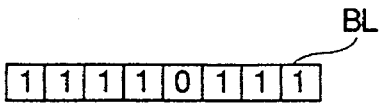

The ON/OFF bit string BL for the ink feed factor $N_k$ of 3 when the ink feed factor $N_n$ is set to nine levels is prepared in the aforementioned manner. FIG. 9 (*a*) shows this ON/OFF bit string BL. In FIG. 9 (a), "0" denotes an OFF bit, while "1" an ON bit.

Next, procedures for obtaining the ON/OFF bit string BL for the ink feed factor $N_k$ of "7" will be described in the following.

Judgment by the processing means 1 becomes "NO" in step 101 shown in FIG. 5. The processing proceeds to step 103 where judgement by the processing means 1 becomes "NO." The processing proceeds to step 105 where the processing means 1 determines "k=1," shifting the processing to step 106. Judgment in step 106 becomes "NO," and the processing proceeds to step 108. This will start procedures given in flow charts in FIGS. 6 through 8. In step 201 shown in FIG. 6, the processing means 1 determines "a=7," and judgment by the processing means 1 becomes "NO" based on this. The processing then proceeds to step 204.

In step 204, the processing means 1 determines "b=4," and based on this, determines the first through fourth bits of the bit string as "OFF bits" in step 205.

The processing means 1 then determines "c=d=0" in step 206, and judgment by the processing means 1 becomes "NO" based on this in step 207. The processing is moved to step 209 where the processing means 1 determines "e=0" and moves the processing to step 210. Judgment by the processing means 1 becomes "NO" in step 210. The processing proceeds to step 214 shown in FIG. 7 where the processing means 1 determines "g=1," and moves the processing to step 215. Judgment by the processing means 1 in step 215 becomes "NO." The processing proceeds to step 216 where judgment by the processing means 1 becomes "NO." The processing proceeds to step 220.

In step 220, the processing means 1 determines "b=5," and based on this, designates the fifth bit of the bit string as "0N bit" in step 221 shown in FIG. 8. The processing then proceeds to step 222 where judgment by the processing means 1 becomes "YES." The processing then moves to step 223 where the processing means 1 determines "h=0." The processing proceeds to step 224.

In step 224, the processing means 1 determines "b=6," and based on this, designates the sixth bit of the bit string as "OFF bit" and determines "h=1" in step 225. The processing proceeds to step 226 where judgment by the processing means 1 becomes "YES." The processing proceeds to step 227. Judgment in step 227 becomes "YES." The processing proceeds to step 224.

In step 224, the processing means 1 determines "b=7," and based on this, designates the seventh bit of the bit string and determines "h=2" in step 225. The processing proceeds to step 226 where judgment in step 226 becomes "YES." The processing proceeds to step 227 where judgment becomes "YES." Then the processing proceeds to step 224.

In step 224, the processing means 1 determines "b=8," and based on this, designates the eighth bit of the bit string as "OFF bit" and determines "h=3" in step 225. The processing proceeds to step 226 where judgment becomes "NO." With this, step 108 shown in FIG. 5 is completed, and the processing moves to step 109.

In step 109, the processing means 1 changes the first through fourth bits and the sixth through eighth bits of the bit string from "OFF bits" to "ON bits," and changes the fifth bit of the bit string from "ON bit" to "OFF bit."

The ON/OFF bit string BL for the ink feed factor $N_k$ of "7" when the ink feed factor $N_n$ is set to nine levels is prepared in the aforementioned manner, as shown in FIG. 9 (*b*). In FIG. 9 (*b*), "0" denotes an OFF bit, while "1" an ON bit.

When the ON/OFF bit strings BL for the ink feed factors 0 through 8 when the ink feed factor $N_n$ is set to nine levels from 0 to 8, for example, are prepared with similar procedures, the number of bits M constituting a bit string is eight, as shown in FIG. 10.

When the ON/OFF bit strings BL for the ink feed factors 0 through 10 when the ink feed factor $N_n$ is set to eleven levels from 0 to 10, for example, are prepared, the number of bits M constituting a bit string is 10, as shown in FIG. 11. The ON/OFF bit string BL shown in FIG. 11 is the same as that shown in FIG. 3 (*b*), Furthermore, when the ON/OFF bit strings BL for the ink feed factors of 0 through 17 when the ink feed factor $N_n$ is set to 17 levels from 0 to 16, for example, are prepared, the number of bits M constituting a bit string is 16, as shown in FIG. 12. In FIGS. 10 through 12, "0" denotes an OFF bit, while "1" an ON bit.

In FIG. 2, the ON/OFF bit string BL for each column CL prepared by the processing means 1 constituting the control unit 10 is stored in the memory means 2.

When the rotary press RP is operated by the main motor MM, on the other hand, the first pulse output means 3 linked to the drive main shaft DS of the main motor MM outputs a pulse signal P1 corresponding to the revolution or rotating speed of the drive main shaft DS. That is, the first pulse output means 3 changes the number of pulse signals P1 per unit time in proportion to the operating speed of the rotary press RP.

The pulse signal P1 outputted by the first pulse output means 3 is inputted to the second pulse output means 4. The second pulse output means 4 reads bits of the ON/OFF bit string BL stored in the memory means 2 one by one sequentially, while repeatedly reading the bit string, every time the pulse signal P1 is inputted, and outputs a pulse signal P2 every time the second pulse output means 4 reads an "ON bit."

That is, the ON/OFF bit strings BL and the corresponding pulse signals P2 for the ink feed factors $N_k$ of 0 through 10 when the ink feed factor $N_n$ is set to eleven levels from 0 through 10, for example, are as shown in FIG. 3. As the ON/OFF bit string BL is read repeatedly, the pulse signal P2 is continuously and repeatedly outputted.

In FIG. 2, the pulse signal P2 outputted by the second pulse output means 4 is inputted to the motor driver 5, which amplifies drive power and matches the drive power to the inputted pulse signal P2, causing the stepping motor SM for driving the ink pump to rotate.

With the aforementioned control operation, the larger the value of the ink feed factor $N_k$ ($0 \leqq k \leqq n$), the larger becomes the rotating angle of the stepping motor SM per the predetermined number of the pulse signal P1 outputted by the first pulse output means 3. The revolution of the stepping motor SM per unit time changes in proportion to the operating speed of the rotary press RP.

That is, with the operating speed of the rotary press RP kept constant, the larger the value of the ink feed factor $N_k$ the more increases ink feed, and ink feed changes in proportion to the operating speed of the rotary press RP.

The above description is concerned with an embodiment having the construction in which the processing means 1 prepares an ON/OFF bit string BL corresponding to the ink feed factor $N_k$ as described with reference to FIGS. 5 to 8.

The construction may be such that since each column CL of a process film being printed FL is measured in advance by the printing element ratio measuring means, an ON/OFF bit string BL for the ink feed factor $N_k$ corresponding to the printing element ratio measured by the printing element ratio measuring means is inputted manually or automatically from the input means 6, and stored in the memory means 2.

With the construction in which an ON/OFF bit string BL is inputted from the outside, as described above, a shift register may be used as the memory means 2, in place of a RAM. By using a shift register, the circuit configuration of the control unit 10 can be simplified.

As is evident from FIGS. 10 to 12, the operation of the stepping motor SM can be effected smoothly by distributing ON bits almost uniformly to an ON/OFF bit string BL.

In this embodiment, description has been made about a so-called half-deck type printer in which the impression cylinder IC is caused to make contact with the blanket cylinder BC, as shown in FIG. 2, to print on only one side of a paper web W. This invention can be applied to a so-called B-B (blanket-to-blanket) type, in which, instead of the impression cylinder IC in FIG. 2, another blanket cylinder having another plate cylinder and an inking assembly is provided so that the paper web W is caused to travel between the two blanket cylinders to print on both surfaces thereof, or a spot B-B type, or a half-deck B-B type or a satellite type.

Moreover, this invention can be applied not only to the offset types printer, as described above, but also to the direct printing type, or the lithographic press, the letterpress printing press, or the plate printing press, or the stencil printing press.

As the ink pump constituting the ink pump unit according to this invention, the plunger pump, the piston pump, the injection pump, the gear pump, the screw pump, the vane pump and various other known pumps can be used.

This invention having the foregoing construction and operation can achieve the following effects.

The ink pump control system of this invention can feed ink in such a volume as to match printing element ratio and the operating speed of the rotary press since the ink pump control system of this invention controls the operation of the ink pump based on the ON/OFF bit string prepared by carrying out extremely simple calculation and processing in accordance with predetermined procedures on the basis of an ink feed factor determined by the printing element ratio of an area to which ink is to be fed, and on the pulse signal outputted by the pulse output means linked to the operation of the rotary press. Since a CPU used in this invention as the processing means may not necessarily be of a sophisticated type, the manufacturing cost of the ink pump control system of this invention can be reduced.

If the ink pump control system of this invention has such a construction that the ON/OFF bit string BL is prepared in advance outside the ink pump control system, and the ON/OFF bit string BL corresponding to the number of levels of the ink feed factor and the printing element ratio measured by the printing element ratio measuring means is inputted for each column, a CPU used as the processing means may not necessarily be required. This could lead to a further reduction of manufacturing cost.

By adopting an appropriate transmit/receive means for the take-over point of pulse signals and signals of the ON/OFF bit string, the number of linking lines can be reduced. This could help reduce the manufacturing cost of the ink pump control system.

Since the arithmetic operation is applied only to the preparation of the ON/OFF bit string in the ink pump control system of this invention, the conventional processing of frequency division for dividing the frequency of basic clock pulses in accordance with the operating speed of the rotary press can be eliminated. This enables the ink pump control system of this invention to perform control with higher precision than the conventional system.

The ink pump control system of this invention can operate the stepping motor smoothly because ON bits are distributed almost evenly in the ON/OFF bit string. This could lead to a reduction in vibration, and maintain the precision of the ink pump for a long period.

What is claimed is:

1. An ink pump control system comprising:

a rotary press;

an ink pump mounted on said rotary. press;

a stepping motor driving said ink pump;

a first pulse output means for outputting a pulse signal in proportion to an operating speed of said rotary press;

printing element ratio measuring means for measuring a printing element ratio of an area of a plate surface to which ink is to be fed;

a memory means for obtaining in advance said printing element ratio from said printing element ratio measuring means, and storing an ON/OFF bit string corresponding to said printing element ratio, ON bits in said ON/OFF bit signal being distributed substantially evenly;

a second pulse output means for sequentially reading each bit in said ON/OFF bit string stored in said memory means every time a pulse signal outputted by said first pulse output means is inputted, and outputting a pulse signal corresponding to read bits in said ON/OFF bit string; and a motor driver connected to said second pulse output means and said stepping motor for operating said stepping motor in accordance with said pulse signal outputted by said second pulse output means.

2. An ink pump control system as set forth in claim 1, wherein said first pulse output means is directly and individually linked to a plurality of said second pulse output means, and a plurality of said memory means are directly and individually linked to said plurality of said second pulse output means.

3. An ink pump control system as set forth in claim 1, wherein a transmitting means is linked to said first pulse output means and a plurality of said memory means, a receiving means is linked to said transmitting means, and a plurality of said second pulse output means is linked to said receiving means.

4. An ink pump control system as set forth in claim 1, wherein said printing element ratio :measuring means comprises a light source illuminating a process film for producing a plate, a photoelectric conversion device for photoelectric conversion in accordance with a transmission rate of said process film illuminated by said light source, and a transport device for transporting said process film to a gap facing a light receptor of said photoelectric conversion device, so that the printing element ratio of said plate surface area to which ink is to be fed can be obtained.

5. An ink pump control system as set forth in claim 1, wherein a RAM is used as said memory means to store said ON/OFF bit string;

a processing means is connected to said memory means for preparing said ON/OFF bit string, in which a predetermined number ON bits are distributed, in accordance with data on an ink feed factor corresponding to said printing element ratio of said plate surface area to which ink is to be fed.

6. An ink pump control system as set forth in claim 1, wherein a shift register is used as said memory means to store said ON/OFF bit string; processing means connected to said memory means and for preparing said ON/OFF bit string, in which a predetermined number of ON bits are distributed, in accordance with data on an ink feed factor corresponding to said printing element ratio of said plate surface area to which ink is to be fed.

7. An ink pump control system as set forth in claim 2 wherein said first pulse output means is directly and individually linked to a plurality of said second pulse output means, and a plurality of memory means are directly and individually linked to a plurality of said second pulse output means.

8. An ink pump control system as set forth in claim 1 wherein a transmitting means is linked to said first pulse output means and a plurality of memory means, said receiving means is linked to said transmitting means, and a plurality of said second pulse output means is linked to said receiving means.

9. An ink pump control system for a rotary press comprising:

an ink pump mountable on the rotary press;

a stepping motor connected to said ink pump and driving said ink pump in response to pulses;

a first output pulse means for generating a speed pulse signal proportional to an operating speed of the rotary press;

printing element ratio means for measuring a printing element ratio of ink required to area of a plate surface to which ink is to be fed;

processing means for generating an ON/OFF bit string corresponding to said printing element ratio;

second pulse output means for receiving said speed pulse signal and sending said ON/OFF bit string to said stepping motor for each pulse in said speed pulse signal.

10. A system in accordance with claim 9, wherein:

said processing means substantially evenly distributes ON bits in said ON/OFF bit string.

11. A system in accordance with claim 9, wherein:

said processing means substantially symmetrically distributes ON and OFF bits in said ON/OFF bit string about a center of said ON/OFF bit string.

12. A system in accordance with claim 9, wherein:

said ON/OFF bit string includes bits which can be one of ON bits and OFF bits a ratio of said ON bits and said OFF bits being similar to said printing element ratio.

* * * * *